US006478189B1

(12) United States Patent
Mooney

(10) Patent No.: US 6,478,189 B1
(45) Date of Patent: Nov. 12, 2002

(54) APPARATUS FOR ADDING FLUID ADDITIVES TO FLUIDS

(75) Inventor: Brian Francis Mooney, Dun Laoghaire (IR)

(73) Assignee: Cassiano Limited, Linkardstown (IR)

( * ) Notice: Subject to any disclaimer, the term of this patent is extended or adjusted under 35 U.S.C. 154(b) by 0 days.

(21) Appl. No.: 09/593,825

(22) Filed: Jun. 13, 2000

Related U.S. Application Data

(62) Division of application No. 09/125,492, filed as application No. PCT/IE97/00011 on Feb. 21, 1997, now Pat. No. 6,095,371.

(30) Foreign Application Priority Data

| | | |
|---|---|---|
| Feb. 21, 1996 | (IR) | S960151 |
| Apr. 22, 1996 | (IR) | S960306 |
| May 27, 1996 | (IR) | S960369 |
| Jun. 21, 1996 | (IR) | S960462 |
| Oct. 14, 1996 | (IR) | S960721 |
| Oct. 14, 1996 | (IR) | 960722 |

(51) Int. Cl.[7] ..... B67B 7/00

(52) U.S. Cl. ..... 222/1; 222/30; 222/57; 222/64; 222/145.5; 222/153.01

(58) Field of Search ..... 222/1, 52, 64, 222/57, 144.5, 145.5, 145.6, 183, 153.01, 30, 36, 153.03, 564

(56) References Cited

U.S. PATENT DOCUMENTS

| | | | | |
|---|---|---|---|---|
| 3,283,957 | A | * | 11/1966 | Henderson |
| 3,604,594 | A | * | 9/1971 | Isreeli |
| 4,237,536 | A | * | 12/1980 | Enelow et al. |
| 4,247,018 | A | * | 1/1981 | Credle |
| 4,262,710 | A | | 4/1981 | Nomura et al. |
| 4,353,482 | A | | 10/1982 | Tomlinson et al. |
| 4,789,100 | A | | 12/1988 | Senf |
| 4,886,367 | A | | 12/1989 | Bragg et al. |
| 5,251,785 | A | * | 10/1993 | Hayden et al. |
| 5,344,044 | A | | 9/1994 | Hayden et al. |

* cited by examiner

*Primary Examiner*—Christopher Kim
(74) *Attorney, Agent, or Firm*—Edward W. Callan

(57) ABSTRACT

A delivery vehicle is used to deliver oil with or without a marker and is provided with apparatus which includes a reservoir of marker and an injector pump for adding marker to the oil. A controller records the occurrence of an event associated with the depletion of the reservoir which has an upper section, a lower section and a marker level sensor located at a narrow constriction between the two sections. The apparatus includes a blender which causes fluid flow to occur at different rates and is operable so that the slugging effect of marker injection is reduced. The injector pump is arranged to provide a delay prior to each forward or reverse stroke. The memory devices of the controller are locked or sealed so as to deny access to reprogram the controller.

13 Claims, 4 Drawing Sheets

APPARATUS FOR ADDING FLUID ADDITIVES TO FLUIDS

This is a division of application No. 09/125,492 filed Aug. 19, 1998, now U.S. Pat. No. 6,095,371 which is a 371 of PCT/IE97/00011, Feb. 21, 1997.

The present invention relates to a method and apparatus for adding a fluid additive to a fluid. The invention relates particularly, but not exclusively, to a method and apparatus for securely adding an additive to fluid dispensed from a delivery means which is required to deliver fluid with and without an additive. The invention also relates particularly, but not exclusively, to a delivery means which is a delivery vehicle and to a method for securely adding marker chemical to middle distillate oils.

Many countries impose different rates of taxation on particular grades of middle distillate oils. For example, diesel grade oil may be taxed at a relatively high rate when used for powering on-road vehicles, but be untaxed or taxed at a lower rate when used for heating purposes, or for powering off-road vehicles. Where such variations exist, it is necessary for the taxation authority to ensure that the untaxed or lower taxed oil cannot be used in circumstances where the higher tax rate should apply. Various methods have been used to meet this need. One method requires the users of higher taxed oil to keep records of distances travelled by means of a special meter and account for tax on this basis from time to time. Another more common method involves collecting the tax on the higher taxed oil at source and chemically marking the untaxed or lower taxed oil in order that any prohibited use can be readily detected.

Chemical marking usually takes place at the refinery or bulk storage depot. It typically comprises two main components, a coloured dye marking chemical which provides readily recognised marking on visual inspection and an invisible second marking chemical which is such more difficult to remove than the dye chemical.

The use of chemical marker, or marker, has several advantages over the metering method. Firstly, it is more easily controlled. Secondly, it eliminates the need for special meters. Thirdly, it eliminates the need to record and account for distances travelled. Fourthly, it taxes fuel consumption rather than distance travelled and therefore encourages fuel efficiency.

However, it has the relative disadvantage that the same delivery vehicle will not normally be able to deliver both marked and unmarked oil where the oil is stored in a common tank on the vehicle. This arises because the systems available for the addition of marker are unlikely to be sufficiently secure to be accepted by the taxation authorities. For example, with systems which are currently available, a dishonest operator could deliver unmarked oil but record it as marked and thereby avoid payment of the higher tax by either disabling the marker system or by replacing the marker with a different fluid. Throughout this specification, the term secure refers to an acceptable level of prevention of tampering or unauthorised interference.

The requirement to use different delivery vehicles for marked and unmarked oil may increase costs in several ways. Firstly, it may necessitate the need for larger numbers of delivery vehicles. Secondly, it may necessitate additional distances travelled in situations where one destination or route could be delivered by one vehicle if it could deliver both types.

An object of the invention is to overcome these disadvantages by providing a secure system which can add marker at the point of delivery and thus allow one vehicle to deliver both marked and unmarked types.

It is noted that the disadvantages associated with current systems would not be adequately overcome by using a delivery vehicle with two or more tank compartments, separately containing marked oil and unmarked oil, for the following reasons. Firstly it may be troublesome to attempt to match the relative quantities for marked and unmarked oil on the vehicle with the relative quantities required for its delivery schedule. The relative quantities may not even be known in advance. Also, quantities can only be carried in discrete tank sized amounts. Secondly, changing tank use from marked to unmarked use may necessitate frequent cleaning of the tanks, which would be time consuming and costly, and would carry the risk of residual marker contaminating the unmarked oil. Thirdly, where the risk of cross contamination prevented sharing of delivery equipment for marked and unmarked oils, carrying the additional type of oil would further increase costs because it would necessitate equipping the vehicle with an additional pump and flowmeter.

The possibility of cross contamination from shared delivery equipment is also important in the general case of a delivery vehicle with a larger number of separate compartments holding the same basic fluid but with different additives. Such vehicles frequently measure quantities delivered by means of simple dipsticks because a common flowmeter cannot be used due to the possibility of cross contamination and it would be too expensive to provide flowmeters on every compartment. Measurement by dipstick is costly in labour and can be difficult in poor weather conditions. A further object of the invention is to overcome this disadvantage by providing a secure system which can add additive at the point of delivery and thus allow a range of fluid and additive mixtures to be delivered by common equipment, including a flowmeter, without risk of cross contamination.

Additive injection is used to inject fluid additives into base fluids in measured proportions. Reciprocating injection pumps, or injectors, are commonly used as dosing pumps in apparatus used for additive injection.

The injector typically comprises a piston and cylinder arrangement which is provided with an inlet check valve and outlet check valve and a means for reciprocating the piston in the cylinder. When the piston is drawn back in the cylinder, the negative pressure differential created in the cylinder causes the inlet check valve to open and the outlet valve to close or remain closed and additive is drawn into the cylinder through the inlet pipe. When the piston returns in the cylinder, the positive pressure differential created causes the inlet valve to close or remain closed and the outlet valve to open and additive is expelled from the cylinder into the outlet pipe. This process is repeated at each cycle of the injector.

The reciprocating means can be provided in several different ways, a very common means being by the use of a pneumatic piston and cylinder actuator which has its piston coaxial with and linked to the piston of the injector. The pneumatic actuator piston may be reciprocated by conventional pneumatic control means which in turn reciprocates the injector piston. Other examples of reciprocating means include spring returned pneumatic actuators and mechanical eccentric cams driven by rotating means.

Where a pneumatic actuator is used, the operation of the injector actuator and pump will usually be triggered by a pulse or signal from a device associated with a flow meter measuring the flow of base fluid and which will cause the injector to carry out one reciprocating cycle comprising a suction and delivery stroke. If the pulse or signal from the device is arranged such that it occurs each time a set proportion of base fluid passes the flow meter, then the flow of additive pumped by the injector will be proportional to the flow of base fluid. The reciprocating cycle is conventionally seen to have a characteristic length of time for each injector which will determine the maximum rate at which the injector can be run.

Usually some means is provided whereby the volume displaced at each stroke of the injector piston can be varied by varying the length of the piston stroke. Where a pneumatic actuator is used, this variation is frequently provided by a threaded adjustment member which acts as a stop which limits the length of the piston stroke in one direction. This variation allows the pump to be calibrated subsequent to manufacture.

The accuracy of injectors of the type described above, across the range of working pressures, can vary up to about ±5%. Where greater accuracy is required, other means are frequently used, such as proportional metering valve arrangements with direct flow meter control which can readily give absolute accuracies across the range of working pressures within ±0.5%. The metering valve arrangement has the disadvantage that it is usually more complicated and expensive than an injector.

Injectors can also have the disadvantage that they do not mix additive evenly into the base fluid but inject discrete amounts of additive into a continuous stream of base fluid. This intermittent mixing method, sometimes referred to as slugging, gives rise to two potential problems. Firstly, the injected stream comprising additive and base fluid does not initially form an even mixture. Secondly, where small batch quantities are taken from the uneven mixture, the overall resulting proportions may be significantly incorrect and cannot be rectified by subsequent mixing of the batch quantities.

It is also an object of the present invention to provide apparatus which reduces the slugging problems which can arise from the uneven mixture of additive and base fluid caused by the injection method. It is a further object of the present invention to provide apparatus which can provide much improved accuracy in relation to the proportion of additive injected into the base fluid.

The invention is defined in the appended claims 1 to 13 which are incorporated into this description by reference.

The invention will now be described more particularly with reference to the accompanying drawings which show, by way of example only, an embodiment of the invention which is suitable as an apparatus for securely adding marker chemical to middle distillate oils dispensed from a delivery vehicle which is required to deliver oil with and without the marker.

Figure 1:
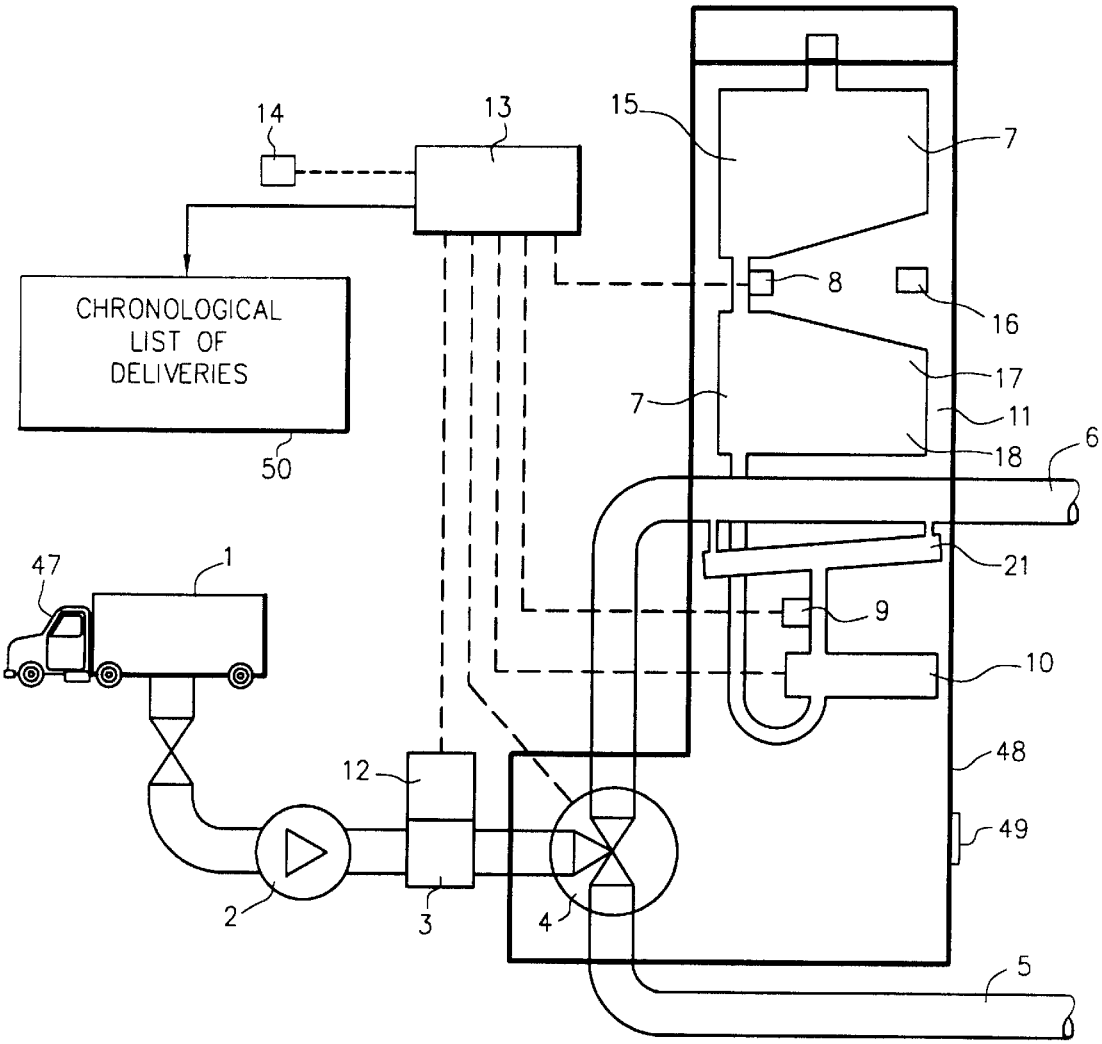
FIG. 1 shows, in diagrammatic form, the delivery and control apparatus on a delivery vehicle, with electronic, electric or pneumatic control lines shown as dashed lines.
Figure 2:
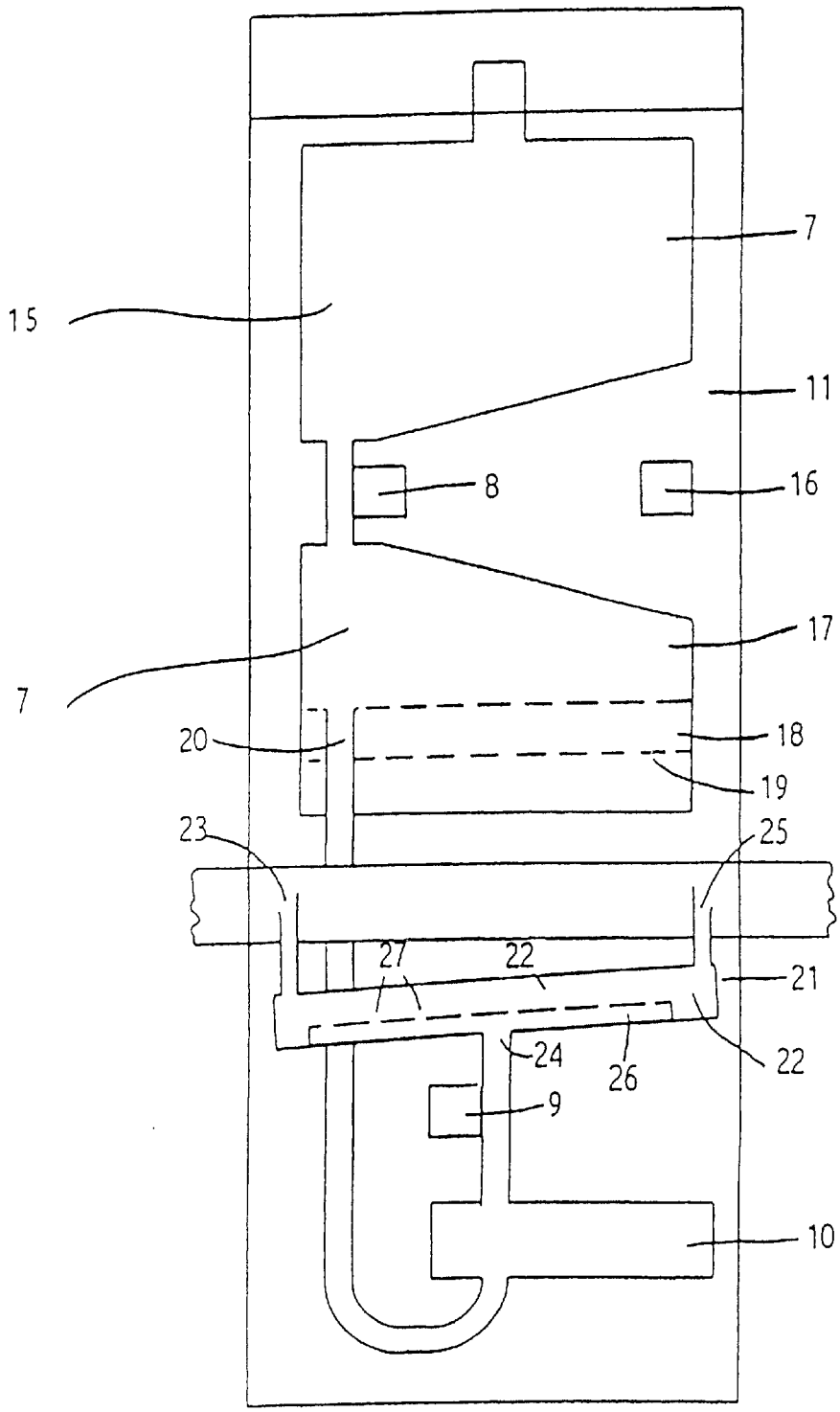
FIG. 2 shows, again in diagrammatic form, a view of part of the delivery and control apparatus shown in FIG. 1 in more detail and on a larger scale.

The following is an index of the reference numerals used in the figures:

1 Oil tank
2 Oil pump
3 Oil flow meter
4 Two-way valve
5 Unmarked oil delivery pipe
6 Marked oil delivery pipe
7 Marker tank
8 Marker level sensor
9 Marker low flow sensor
10 Injector or injector pump
11 Cabinet
12 Pulser unit
13 Electronic control and recording means or controller
14 Cab warning indicator
15 Marker tank, upper section
16 Cabinet access sensor
17 Marker tank, lower section
18 Anti flush section
19 Anti flush retarding means
20 Anti flush outlet pipe
21 Blender arrangement
22 Blender diffusion chamber
23 Blender oil inlet
24 Blender marker inlet
25 Blender outlet
26 Blender manifold
27 Blender manifold openings
28 Injector body
29 Cylinder
30 Piston
31 Cylinder cavity
32 Injector outlet
33 Outlet check valve
34 Injector inlet
35 Inlet check valve
36 Actuator
37 Actuator body
38 Actuator cylinder
39 Actuator piston
40 Link rod
41 Actuator cylinder cavity
42 Actuator port
43 Directional control valve
44 Restrictor check valve
45 Adjustment member
46 Adjustment member lock nut Referring now to FIGS. 1 and 2, there is shown a delivery vehicle oil tank 1 of unmarked oil which may comprise one or a plurality of interlinked compartments. Oil is pumped from the tank 1, by an oil pump 2 through an oil flow meter 3 to a two-way valve 4 connected to one of two delivery pipes, an unmarked oil delivery pipe 5 and a marked oil delivery pipe 6.

The marked oil delivery pipe 6 is connected to a marker system which securely and automatically adds marker in the desired proportion to oil. The marker system comprises a marker reservoir or tank 7 with an upper section and a lower section, the sections being connected by a short pipe section in which a marker level sensor 8 is mounted. The marker tank comprises a further anti-flush section 18 below the lower section of the tank. Marker flows by gravity feed along a marker pipe to an injector unit 10 which pumps marker in the desired proportion into the marked oil delivery pipe 6. The injector unit 10 comprises a fixed stroke piston pump which delivers a set volume of marker when signalled by an electric or pneumatic pulse.

The anti flush section 18 is fitted with retarding means 19, which control and retard flow within the section 18, and with anti draining means, such as an outlet pipe 20 which has its entry in the upper region of the section 18. The retarding means 19 may comprise, for example, a number of perforated baffles or one or more perforated receptacles.

The marker pipe is provided with a marker low flow sensor 9.

The marker tank 7 and all the components of the marker system down to the marked oil delivery pipe 6, including the adjacent section of marked oil delivery pipe 6 are contained within a secure cabinet 11. The cabinet comprises a door with a lock and also comprises a cabinet access sensor 16 which signals if access is made to the cabinet.

A pulser unit 12 is attached to the flow meter 3 and generates pulses in proportion to the flow of oil through the flow meter 3.

The apparatus is also provided with an electronic control and recording device 13, henceforth referred to as the controller 13, which is connected by electronic, electric or pneumatic signal lines to the marker level sensor 8, the marker low flow sensor 9, the cabinet access sensor 16, the two-way valve 4, the injector unit 10, the pulser nit 12 and a cab warning indicator 14, such as a lamp, in the vehicle cab.

The apparatus is additionally provided with a printer which produces a customer coupon which states the quantity of oil delivered and identifies whether it is marked or unmarked oil. In one variation, the printer is an electronically controlled type connected to the controller 13. In another variation, it is a mechanical type connected directly to the oil flow meter 3.

Flow meters with printers and injector units with associated pulser units for adding additives to fluids at the point of delivery are all well known and widely used on delivery vehicles. Electronic control and recording devices of various types are also well known and widely used on delivery vehicles.

The marker level sensor 8 and marker low flow sensor 9 may, for example, comprise electronic proximity switches or electronic reed switches. The marker level sensor may comprise a metal or magnetic float in the tank restriction which is sensed by the electronic switch. The marker low flow sensor may comprise a metal or magnetic part which is lifted against gravity in a vertical tube by the flow pulse and which is sensed by the electronic switch. The cabinet access sensor 16 may be conveniently provided without the need for an additional electronic switch by arranging the wiring from some or all of the other sensors to pass through a coupling, such as a multi-pin plug and socket coupling, which is geometrically situated such that it must be disconnected to gain access into the cabinet 11. The controller 13, can be arranged to detect and record when the coupling is opened by monitoring the circuits connected through the coupling. The two-way valve 4 may comprise two air operated valves which are solenoid controlled by signals from the controller 13.

The operation of the particular embodiment of the invention will now be described.

Many of the elements involved in delivering marked and unmarked oil are similar to those used in various combinations in the known art for the delivery of fluids with or without an additive where the system does not require a high level of security. In these known elements, the two-way valve 4 directs the pumped fluid, oil, into one of two separate delivery pipes 5,6 as appropriate. Additive, marker, fed from a storage tank 7 on the vehicle, is injected into the relevant delivery pipe 6 in proportion to the quantity of oil delivered through the pipe 6 by means of the injector unit 10 controlled by the controller 13 and pulser unit 12 associated with the flow meter 3. A coupon is printed and an electronic record of the delivery made by the controller 13 by means of signals from the pulser unit 12 and the two-way valve 4.

The particular embodiment of the invention includes the following additional elements which are not known in the relevant prior art.

The marker tank 7 is divided into two sections 15, 17 joined by a narrow constriction fitted with a marker level sensor 8. The volume of the upper section 15 corresponds to the standard refill volume, which is typically about 25 litres where marker concentration is about 100 parts per million. The base of the upper section 15 is sloped towards the entry to the constriction in order to ensure that no residual marker remains in the upper section when the level in the tank falls to the level of the marker level sensor 8. The volume of the lower section 17 corresponds to the quantity of marker considered necessary to act as a reserve to provide marked oil in the interim period between the driver being alerted by a signal associated with the operation of the marker level sensor 8 and the tank being refilled with marker. The volume of the lower section 17 may be made relatively large if the possibility or desirability of long interval periods is envisaged. However, the lower section 17 should not be larger than the upper section 15, because a single standard refill might otherwise not reach the level of the marker level sensor 8.

Positioning the marker level sensor 8 in the constriction between the two tank sections 15, 17 increases its accuracy in two ways. Firstly, it measures the level where the cross sectional area is small and a small difference in volume causes a relatively large difference in level. Secondly, its operation is no longer measurably affected by variable inclination of the delivery vehicle and its equipment.

When the marker in the tank 7 falls to the level of the marker level sensor 8, the sensor 8 signals the controller 13 and the event is electronically recorded and a warning indicator 14, such as a lamp in the vehicle cab, remains activated until the marker tank 7 is refilled. The driver will arrange for the marker tank 7 to be refilled during a subsequent visit to the depot where replacement marker is stored.

The tank 7 is always refilled with a defined and accurately controlled quantity of marker. Consistent and tamper resistant refill quantities can be assured in several ways. The refill quantity can be taken from a bulk tank of marker at the depot using a device which will accurately dispense the required defined quantity or alternatively it can be taken from one or a set number of accurately filled containers of marker.

The controller Automatically prepares electronic summarised records of all deliveries in chronological sequence, distinguishing between marked and unmarked deliveries, and simultaneously accurately records real usage of marker related to marked deliveries. Any irregularities are automatically analysed and signalled. The resulting records can be used for legal purposes, spot checks, audits, general statistics or historical checking of suspected blocks of deliveries. Usually the records will not be disclosed to the vehicle operator or driver but will be monitored and stored at a centralised base.

The recorded information allows immediate and subsequent audits or checks to be made to compare the actual proportion of marker added to the oil against the set standard because the known refill quantity is the amount used between operations of the marker level sensor. The controller 13 automatically checks the proportion and indicates if it is not within acceptable tolerances.

The proportions of marker to oil can thus be very accurately calculated each time the level in the upper tank section falls to the level of the marker level sensor. This information can also be used to calibrate or recalculate the stroke capacity of the injector pump, since the number of injector strokes which occurred as the defined quantity of marker was used can be recorded. A constant self calibration of the injector pump can be automatically carried out by the controller by this means. This allows a count of the injector pump strokes to be used as a reasonably accurate measure of the amount of marker used between operations of the marker level sensor and thereby provides the controller with a convenient and accurate means to provide a measure of marker concentration, marker usage and marker stock levels at all times.

The marker low flow sensor 9 is used to ensure that oil is not accidentally or deliberately dispensed through the marked oil delivery pipe 6 without the addition of marker.

If any of the sensors detects an abnormal condition, the event is recorded by the controller which will take appropriate action. This action may include disabling of the dispensing system or activation of systems which are available to alert the central base.

Figure 4:
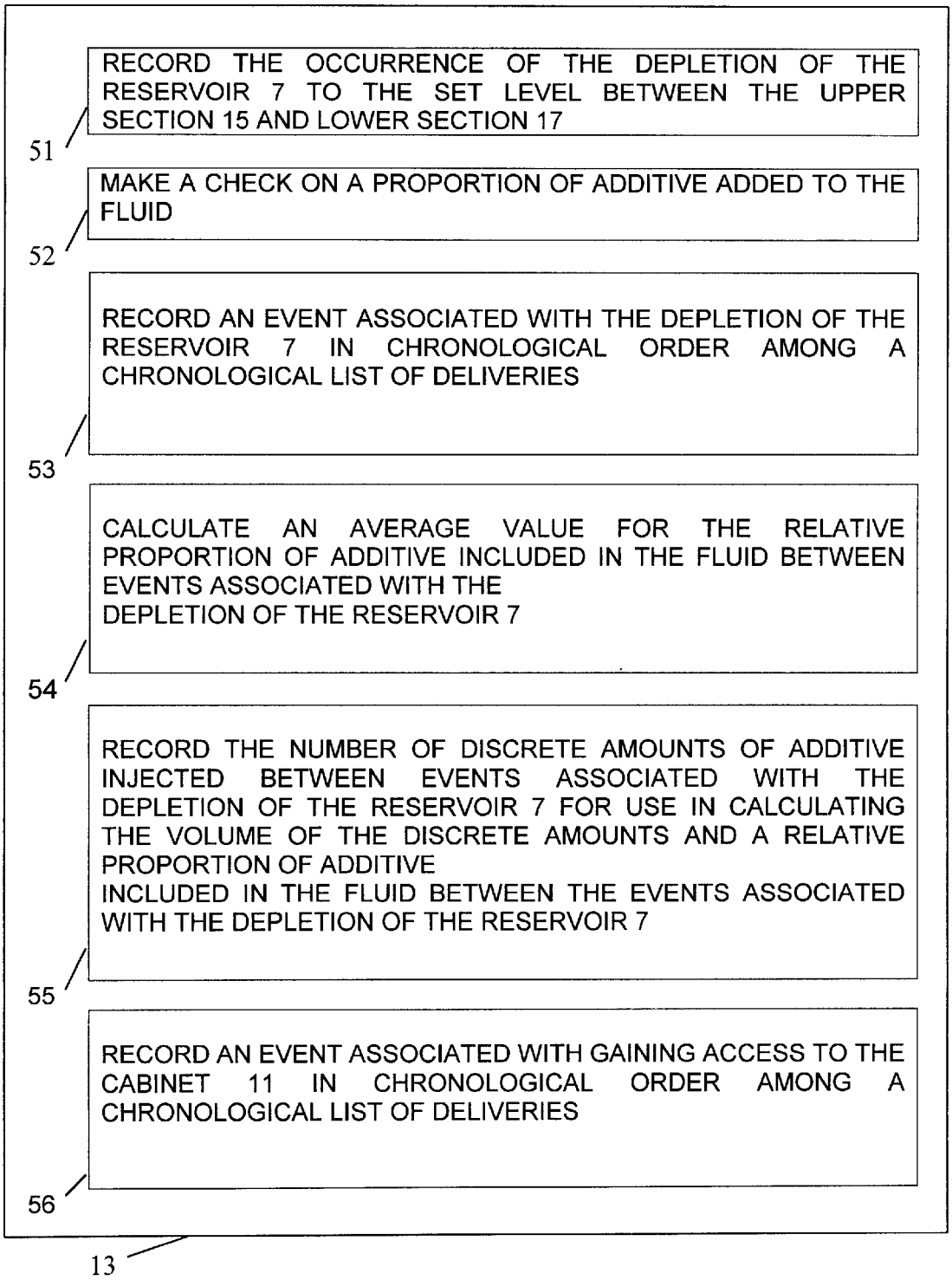
FIG. 4 shows various functions of the controller 13 shown in FIG. 1.

Various functions of the controller 13 are summarized in FIG. 4. The controller 13 records the occurrence of the depletion of the reservoir 7 to the set level between the upper section 15 and lower section 17, as shown at 51. The controller 13 makes a check on a proportion of additive added to the fluid, as shown at 52. The controller 13 records an event associated with the depletion of the reservoir 7 in chronological order among a chronological list of deliveries, as shown at 53. The controller 13 calculates an average value for the relative proportion of additive included in the fluid between events associated with the depletion of the reservoir 7, as shown at 54. The controller 13 records the number of discrete amounts of additive injected between events associated with the depletion of the reservoir 7 for use in calculating the volume of the discrete amounts and a relative proportion of additive included in the fluid between the events associated with the depletion of the reservoir 7, as shown at 55. The controller 13 records an event associated with gaining access to the cabinet 11 in chronological order among a chronological list of deliveries, as shown at 56.

The anti flush section 18 is used as a further safeguard to prevent intermittent replacement of marker by a spurious fluid such as unmarked oil or oil which contains a transient or easily removed dye, or by marker without the invisible second marking chemical. For example, gaining unauthorised access to the cabinet 11 and overriding or disabling the signals from the relevant sensors could allow replacement of the marker by an equal quantity of spurious fluid and visa versa. This deception would not be detected by the marker low flow sensor 9 or by the apparent proportion of marker to marked oil which would be recorded by the controller 13.

The anti flush section 18 contains a significant quantity of marker and is constructed in a way such that it is very difficult to quickly remove all or a significant portion of its contents. The outlet pipe 20 prevents the contents of the section 18 being drained or being blown out under pressure. The retarding means 19 prevent the main body of marker being quickly flushed out by flushing spurious fluid through the device as the flushing fluid will largely short circuit from the inlet to the outlet of the section 18 and little will reach the inner sections of the section 18. The section 18 is arranged such that air can freely vent upwards when the marker tank is filled. The particular embodiment includes retarding means 19 which comprise one or more horizontal perforated separation baffles.

The apparatus is made subject to periodic spot checks to ensure that it has not been tampered with and that the correct type of marker is being used. Where possible, the apparatus is arranged or constructed in a manner which will show up any alterations or unauthorised interference.

It is also important that the security system prevents illicit switching of either the electronic or pnuematic control signals to the two-way valve, as this would otherwise allow an oil delivery to take place which was recorded as marked, with marker being injected into the marked delivery pipe, but with unmarked oil actually being delivered through the unmarked pipe. In one embodiment of the invention, the two-way valve is also enclosed within a secure cabinet and the two-way valve and injection system are pneumatically and electrically interlocked within the cabinet preventing the injection system being operated unless the unmarked oil port of the two-way valve is closed and the marked oil port is open.

Where the two-way valve 5 comprises two air operated valves which are solenoid valve controlled by signals from the controller 13, and where marker is added by an air operated injector pump which is also solenoid valve controlled, the interlocking may, for example, be achieved by the following means. The air supply to the injector pump is taken from the supply which opens the air operated valve port supplying marked oil. This prevents the injector pump being operated when the marked oil valve port is not opened. An air pressure switch, with normally closed electrical contacts, is connected to the air supply which opens the air operated valve port supplying unmarked oil, and the electrical signal to the injector pump solenoid is wired through it. This again prevents the injector pump being operated when the unmarked oil valve port is opened. The solenoid valves, the pressure switch and the interconnections, are all located within the secure cabinet.

In a preferred embodiment, not shown in the figures, the two way valve is enclosed within the same cabinet as the marker tanks and the injection system. The cabinet is of rectangular shape with the tanks and anti flush section occupying one end and sharing common walls with the cabinet. The two-way valve occupies the other end of the cabinet with the oil delivery inlet entering a side wall of the cabinet and the two oil delivery outlets exiting through the top of the cabinet. The injection system occupies a generally central position in the cabinet. This arrangement can be made sufficiently small to fit at low level between the chassis members of a typical oil delivery vehicle. In one arrangement the external dimensions of the cabinet are 400 mm in height, 500 mm in width and 650 mm in length. An arrangement of this type has several potential advantages. Firstly, the cabinet is well protected from crash damage and consequent danger of spillage of the marker chemical. Secondly, the marker chemical is stored and refilled at a safe low level. Thirdly, the single cabinet arrangement allows most of the pipework and electrical connections to be prepared and tested before being fitted to the vehicle.

Other variations of marker reservoir 7 and means to detect the rate at which marker is replaced may be used in effecting the apparatus of the invention. For example, the reservoir 7 may comprise one or more containers of marker linked to the apparatus. The audit or check to compare the actual proportion of additive added to the fluid against set standards may also be made by securely counting or recording the occurrence of various events associated with the filling, depletion, replacement or connection of container or tank reservoirs 7.

Various types of electronic control and recording means, are used on tanker vehicles which deliver oil or other fluid products. They frequently comprise an electronic controller or a computer in the vehicle cab used in conjunction with an electronic flow control device, hereafter referred to as a flow counter, pulsed from a flow measurement device on the oil delivery line. Vehicle computers are usually termed OTCs, or on-truck-computers. The flow counter or electronic controller usually comprises a small programmable logic unit and typically includes a memory device such as an erasable programmable read-only memory or EPROM device. The OTC usually compiles the electronic record of the deliveries and other relevant information and this record is retrieved by various means for subsequent checking and storage.

A problem which arises from the use of an OTC where additive must be securely added on a delivery vehicle is that it is very difficult to prevent the possibility of dishonest operators reprogramming or hacking into the software system to manipulate the record or calculation of additive concentration. OTC systems are very similar to ordinary personal computer systems and a wide cross section of people are familiar with their operation and manipulation. It is an object of the present invention to overcome or reduce this problem.

The present invention provides various means which prevent reprogramming or hacking into the flow counter or controller software. These means include apparatus which physically denies access required for reprogramming or hacking into the flow counter or controller by the use of a mechanical or electronic locking means or by means of a sealing means, sometimes used in conjunction with an enclosure means which isolates one or more memory devices comprising the flow counter or controller and to which access must be gained in order to modify or disable the security system. The enclosure means may comprise a secure casing with a lockable or sealable opening. The locking means may, for example, comprise a key operated locking device.

The sealing means may, for example, comprise encapsulation in a sealing material such as resin or fixing with a wire and lead tag.

The present invention also includes detection means which monitor physical access to or removal of one or more memory devices comprising the flow counter or controller which permits reprogramming or hacking to be carried out. The security system is activated if illicit access or removal is detected. The detection means may, for example, comprise a normally live circuit within the memory devices or some part of the flow counter or controller which is arranged such that it is broken if the relevant physical access to or removal to permit reprogramming or hacking takes place. The detection means may also, for example, comprise an electronic or electric sensor which is activated if the relevant physical access to or removal to permit reprogramming or hacking takes place.

Isolation of the flow counter or controller memory devices can be achieved in ways that are not possible with a computer such as an OTC. Unlike a computer or OTC, the memory devices normally cannot be reprogrammed or hacked into using the operational external input or output wires or terminals. Also, the memory devices are very much smaller than an OTC and have no operator interfaces such as screens or keyboards, which accordingly allows them to be readily encapsulated or enclosed in a secure casing.

The present invention also provides for one or more of the memory devices comprising the flow counter or controller to be replaced by memory devices which cannot be reprogrammed. An OTP or one-time-programmable device is an example of such a memory device.

The present invention additionally provides for part of the security system to be duplicated on the OTC and on the electronic flow counter or controller. If either system detects illicit manipulation, it will independently activate a security system, such as shutting down the truck delivery system, marking an electronic record or alerting the central base. Usually the electronic flow counter or controller will have more limited programmable capacity than the OTC and will therefore operate a simpler security system than the OTC. However, the invention may also be used on trucks without OTCs.

Returning to FIGS. 1 and 2, the apparatus is also provided with a blending means or blender 21 connected to the delivery pipe 6. The blender 21 includes a manifold 26 and a receptacle or diffusion chamber 22. The diffusion chamber 22 may comprise an elongate tube. The injector outlet pipe 32 communicates with the manifold 26 through a short length of pipe which is connected through a marker inlet 24 to the manifold gallery which in turn communicates with the diffusion chamber through a row of holes or openings 27 along the upper surface of the manifold 26. The diffusion chamber communicates with the delivery pipe 6 through a blender base fluid inlet 23 at one end and a blender outlet 25 at the other end. The blender 21 is positioned below the delivery pipe 6 and at an inclined angle to prevent air entrapment and to prevent leakage of the mixture of oil and marker from the diffusion chamber 22 into the delivery pipe 6 between deliveries. The manifold 26 is also arranged with the manifold openings 27 on its upper surface so that additive is retained in the manifold between deliveries. The blender inlet 23 and outlet 25 pipes are raised in the delivery pipe 6 to prevent ingress of sludge or debris and are provided with oblique openings facing respectively upstream and downstream in the delivery pipe 6. Although not shown in the figures, the outlet pipe 25 may be advantageously terminated with a bend such that the axis of the pipe end is aligned with the axis of the delivery pipe and its opening faces downstream. This will help to reduce local turbulence and promote more even flow from the outlet pipe 25. The relative flow of oil through the diffusion chamber 22 is regulated by a restriction in the outlet 25 pipe which is also not shown in the figures.

The inlet 23 pipe is deliberately arranged with very little resistance in order that the greater part of the flow surge which occurs when injection takes place, flows backwards through the inlet 23, thus preventing a slug of oil-marker mixture being displaced into the delivery pipe 6. The backward flow through the inlet 23 into the delivery pipe comprises oil without marker. As oil flows in the delivery pipe 6, a pressure differential is created between the two openings 23, 25 of the diffusion chamber 22 which causes flow within it, but at a lower speed. The speed may be set by suitable arrangement of the restriction.

Additive injected into the diffusion chamber 22 mixes with base fluid along the manifold 26 to form an elongated body of mixed or partly mixed fluid, and the outlet 25 in the diffusion chamber 22 is restricted to regulate the flow and relative speed of fluid passing through the diffusion chamber 22 to ensure that there is overlap between successive elongated bodies passing through the diffusion chamber 22. This ensures that a substantially continuous stream of mixed fluid enters the delivery pipe 6 from the blender outlet 25 of the diffusion chamber 22.

It is sometimes advantageous to ensure that additive is not removed from the manifold 26 when injection is not taking place either by the passage of oil over the openings 27 or by pressure differentials set up within the diffusion chamber 22 which could cause oil to enter some of the openings 27 in the manifold 26 and displace additive through openings 27 where the fluid is at a lower pressure. Such removal of additive shall henceforth be referred to as scouring. Scouring will give rise to reduced accuracy in the proportion of oil and additive in that the scoured additive will increase the concentration when scoured but will reduce the concentration at the following injection as the manifold 26 will require to be replenished. When scouring occurs, its effects will be variable due to variations in the flow of oil in the delivery pipe 6 and to factors such as temperature influenced viscosity effects.

The possibility of scouring is reduced or prevented by various means. These include avoiding severe irregularities or resistances in the diffusion chamber 22 which might give rise to pressure differentials along the manifold 26. In particular, where a diffusion chamber 22 of the type described in the preferred embodiment is used with a single manifold 26, the flow restrictors should be either upstream or downstream of the manifold. Scouring is also reduced or eliminated by arranging the manifold openings 27 to be of small cross sectional area and to be of length which is relatively long in proportion to their width. For example, a manifold 26 of around 150 mm to 200 mm in length may be provided with about 6 holes of diameter 1 mm and depth 10 mm. It is important to ensure that the injector pump 10 develops sufficient pressure in the additive to allow it to pass through the holes within the allowable time cycle and that the additive is not of a type which will clog small passageways. Alternatively, scouring can be reduced or minimized by providing small check valves in the manifold 26. For example, if the manifold 26 gallery is fed from the centre, a check valve may be placed in each section of the gallery to prevent backwards flow and thereby prevent internal circulation between its two sections. Alternatively, the manifold 26 may comprise manifold openings 27 where each is provided with a separate check valve.

The effect of any scouring which might accidently occur is minimised by reducing the quantity of additive contained in the manifold. This is achieved by ensuring that the connecting passages and galleries to the manifold openings 27 are not made larger than is required for the operation of injector pump 10 within the allowable time cycle or is necessitated by the manufacturing process.

When regulating the rate of flow in the diffusion chamber 22 to set the degree of overlapping of the elongated bodies, a compromise must be reached. On the one hand, reducing the flow will give a greater degree of overlapping and consequently a more homogeneous mixing in the diffusion chamber 22. On the other hand, reducing the flow and increasing the degree of overlapping will increase the average concentration of marker in the oil in the diffusion chamber 22. This will have the potential drawback of increasing any problems of fluid expelled from the diffusion chamber 22 by the injection stroke or problems of leakage between the diffusion chamber 22 and the delivery pipe 6 between deliveries. In practice a rate of flow which causes one to three overlaps of the elongated bodies has been found satisfactory.

The use of manifold openings or outlet holes 27 of small diameter and relatively long length has advantages in addition to preventing or minimising scouring or leakage of marker into the diffusion tube 22 when the system is out of operation. The small holes lengthen the time period of injection and thereby assist the formation of the elongated bodies and reduce the effect of fluid being expelled from the diffusion chamber 22 during injection. The small holes also help to ensure even flow through each of the manifold openings or holes 27 during injection.

The blending means 21 reduces or eliminates the problems and inaccuracies which arise from slugging where shots of additive are injected into the continuous stream of oil. If not otherwise dealt with, the oil and additive mixture delivered into the delivery line would comprise alternating quantities of marked and unmarked oil. Although these alternating quantities would usually mix together in the storage tank into which they are delivered, if a small quantity of oil and additive mixture is delivered or if a small sample is taken for examination, the proportion of additive in the mixture would most likely be incorrect. Slugging also gives rise to a potential security problem in that it is possible to separate the marked and unmarked quantities of oil passing down the delivery line by connecting a length of transparent hose to the end of the line and manually switching the hose end between two tanks as the oil alternates between marked and unmarked. Switching could also be achieved without the use of a transparent hose by initial observation of the outflowing oil and then using the noise of the injector pump 10 when the appropriate sequence pattern becomes clear. In either of these cases it is possible for the operator to reduce the flow from the hose end and thereby increase the interval time between injection pulses. Switching could also be achieved automatically using a photocell controlling a change-over valve, in which case the deception could be achieved by the recipient without the delivery operator being aware that it was taking place. Slugging also gives rise to a potential problem where the marker or additive is of a corrosive nature. This concerns the possibility of damage to ordinary hose and seal materials where dispensing hoses and seals are left with concentrated localised slugs of marker over prolonged periods.

In most cases the effectiveness of the blending means 21 is increased by any mixing which takes place between additive and base fluid within the blending means 21 or the diffusion chamber 22 for reasons which include the following. Firstly, well mixed fluid within the blending means 21 or diffusion chamber 22 will promote more even dispersion in the delivery means 6 as it gradually flows into it. Secondly, any quantity of fluid which might be displaced into the delivery means 6, when additive is injected into the diffusion chamber 22, should ideally comprise a well mixed and diluted combination of additive and base fluid to minimise slugging effects. The blending means 21 may be geometrically arranged such that injection of additive creates turbulence within the blending means 21 to increase mixing within it. The blending means 21 may also be provided with baffles or irregularities to increase mixing as the additive and base fluid pass through it.

The blending means 21 may be arranged in various other ways and the suitability of different variations may depend on the flow of base fluid, the proportion of additive injected, the rate of injection and the viscosities and miscibilities of the two fluids. In some cases the manifold 26 may be omitted from the diffusion chamber and injection take place from an outlet with mixing occurring within the chamber 22 by other means including turbulence.

The blending means 21 may also comprise arrangements which do not include a manifold 26 but where injection occurs at different outlets or openings in the blending means or in the delivery means 6.

The blending means 21 may additionally comprise the deliberate slowing down of the injection stroke. This can be achieved by several means including arranging the injection opening or manifold openings 27 to be of small cross section, or by restricting the exhaust of the actuator where the injector 10 is driven by an air actuator 36. Slowing down of the injection stroke can give rise to several benefits. Firstly, it will help to spread the slug as it is injected into the base fluid. Secondly, it will reduce fluid and mechanical shock within the injection system by reducing the velocity of the moving parts of the injector pump and the velocity of the fluid. Thirdly, it may reduce any momentary effects on fluid velocity within the blender diffusion chamber which might otherwise cause an uneven flow rate from the blender into the delivery pipe.

The blending means 21 may also comprise one or more injection points or an injection manifold 26 located in a section of a delivery means 6, where flow speed is reduced by increasing the relative cross sectional area.

The blending means 21 may also be located in the delivery means 6 downstream of the injection position. In this instance the flow in the delivery means 6 is divided into separate receptacles or channels with different resistances to flow, such that individual quantities of the separate flows are staggered or spaced apart as they come together again in the delivery means 6. Thus, a slug of additive moving in the stream of base fluid will be broken into several smaller spaced apart slugs of additive. The overall cross sectional area of flow may be increased to compensate for the lower flow rates in the restricted channels. The cross section of individual channels or groups of channels may be increased in proportion to the resistance to flow to allow even sizing and separation of the smaller slugs.

The blending means 21 may be used with a wide variety of fluids including gases where suitably arranged. Where it is required to blend two or more fluids where an additive is injected in very low concentration, it may be advantageous to use a combination of two or more blending means 21 with the base fluid of one being the injected additive of another.

Figure 3:
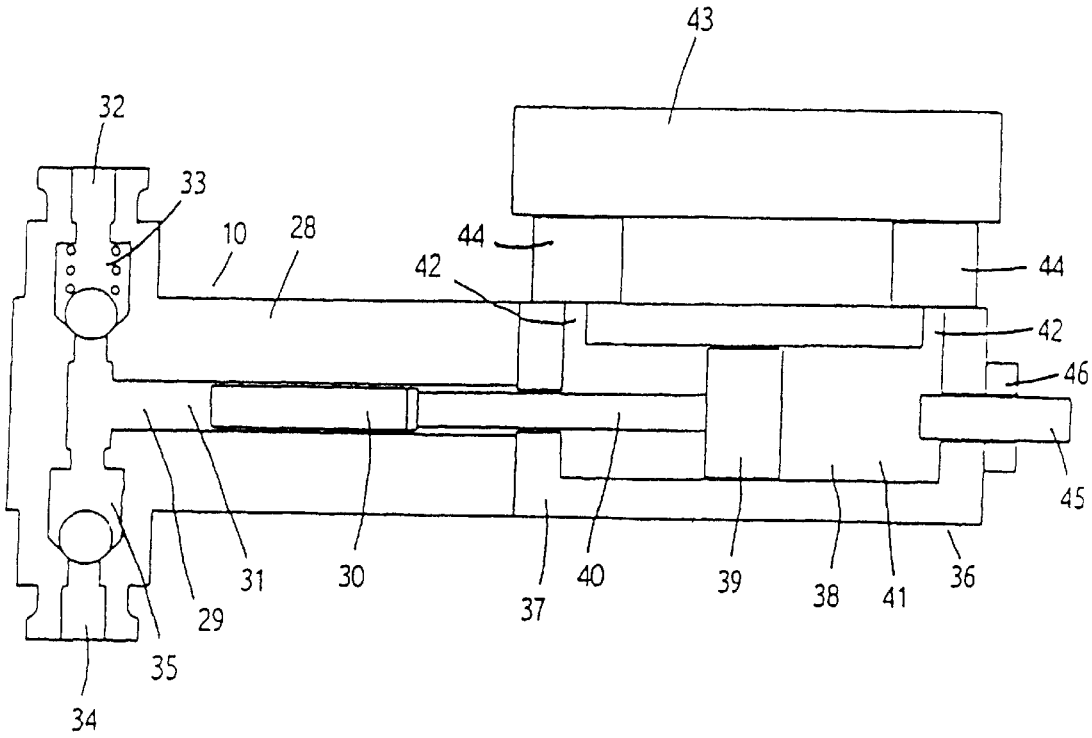
FIG. 3 shows a diagrammatic and simplified view of an injector with a pneumatic actuator provided with directional and speed control valves. The injector and pneumatic actuators are shown in section.

Referring now to FIG. 3, the injector 10 comprises an injector body 28, a cylinder 29 and a piston 30. The piston 30 and cylinder 29 arrangement is provided with seals which are not shown in the figure, but which may be fixed in the injector body 28 and make sealing contact with the piston 30 or link rod 40. The piston 30 is operable to reciprocate in the cylinder 29 thereby increasing and decreasing the volume in the cylinder cavity 31. The injector 10 is provided with an inlet 34 which communicates with the cylinder cavity 31 and is connected to an inlet pipe feeding from the marker tank. The inlet 34 is provided with a check valve 35 which allows additive to enter the injector 10 but prevents flow in the opposite direction. The injector 10 is also provided with an outlet 32 which communicates with the cylinder cavity 31 and which is connected to the blender marker inlet 24 and marked oil delivery pipe 6. The outlet 32 is provided with a check valve 33 which allows additive to leave the cylinder cavity 31 but prevents flow in the opposite direction. Reciprocating of the piston 30 will accordingly draw additive in through the inlet 34 and pump it out through the outlet 32. The check valves 33, 35 may of the known type where ball members seal against seatings and are held against the seatings by the assistance of gravity and springs. Typically, the inlet check valve will have a metal to metal seating and be closed by gravity and the outlet check valve will have an elastomer seating and be closed by a spring.

The injector 10 is provided with a pneumatic actuator 36 which reciprocates the injector piston 30. The actuator 36 comprises an actuator body 37, an actuator cylinder 38, an actuator piston 39 and a link rod 40. The actuator piston 39 and actuator cylinder 38 arrangement is provided with seals which are not shown in the figure. The injector body 28 and actuator body 37 may be made in one piece. The injector piston 30 is axially connected to the actuator piston 39 by the connecting link rod 40 which may conveniently be arranged to allow some lateral movement. Each side of the actuator cavity 41 is connected to an actuator port 42 which communicates with a solenoid operated directional control valve 43 via restrictor arrangements 44 which control the speed of the actuator, such as restrictor and check valve arrangements 44. The restrictor and check valve arrangements 44 allow air to freely enter the cylinder cavity 41 through the check valve but restricts its exit by forcing the air to pass through the restrictor valve. The solenoid valve 43 is thus operable to control the reciprocation of the injector piston 30 and the restrictor and check valve arrangements 44 are operable to control the speed of the movement of the injector piston 30.

The actuator 36 is provided with a threaded stroke adjustment member 45 which enters the actuator through a threaded hole and limits the stroke of the actuator piston 39 in one direction. The position of the adjustment member 45 can be varied by screwing it in or out of the actuator 36 and can be locked in position with a lock nut 46.

The accuracy of the injector can be affected by variations in operating conditions. These variations include pressure variation in the oil delivery system. Some of this variation arises from the effect of varying flow rates and the resistance of the delivery hose, some from the elevation at which the delivery is being made in relation to the level of oil in the vehicle and some is due to the position of the operator controlled valve at the delivery hose gun, which may be open or partly closed during delivery. Other variations include the temperature related viscosities of the oil and additive, which can affect back pressures and valve operation, and temperature effects on the resilience of valve or piston seals and on friction effects in the valves or actuator.

When an injector is operating in a conventional manner the injector check valves can remain in a dynamic situation during part of the cycle when, ideally, they should be firmly closed. Check valve dynamics are generally not well understood when the valves are operating rapidly and the inaccuracies arising from this phenomenon are conventionally dealt with by the process of calibration which compensates for losses across the valves. The present invention provides that the injector cycle of operation is arranged to provide a deliberate preset delay prior to the suction or delivery strokes to allow the valves to completely settle and arranging the injector size to be such that there is sufficient pumping capacity to allow these delays.

Variable flexing of piston seals may give rise to variations in the volume of additive pumped on each stroke of the injector. This potential source of inaccuracy can be reduced by arranging the injector pump with a relatively high stroke to diameter ratio which reduces the seal surface area in relation to the cylinder capacity. Increasing this ratio also increases the relative accuracy of using end stops on the stroke to control the volume as it minimises the volume in relation to the stroke length.

The injector pump and actuator are also arranged such that the force developed by the actuator is much greater than the force required by the injector pump over the complete range of pressures possible in the base fluid delivery means. This will minimise the effects of variations in delivery line pressure on pump performance. It will also minimise the effects of friction variations in the injector or actuator.

The injector stroke capacity is arranged relatively small, but not so small that the stroke rate is too high to allow sufficient time for the valves to fully close as discussed earlier.

The actuator may be provided with restrictor and check valve arrangements which control the speed of the actuator in each direction. This prevents mechanical impact and shock on the end stops and other parts, which reduces piston bounce and noise. It also reduces wear on the end stops and helps to maintain consistency of stroke length over the life of the injector. It additionally reduces hydraulic shock and instability in the fluid systems which assists valve stability and helps prolong the life of seals and components. High piston velocity can create undesirable high kinetic energy in the fluid, both within and outside the injector, the dissipation of which can unsettle the operation of the check valves and other moving parts when the piston reaches the end of its stroke.

An example of an application of the invention is given below where the oil pump flow rate is 10 litres per second, the oil line operating pressures vary from 0 bar to 9 bar, the additive concentration is 100 parts per million and the regulated air supply to the actuator is 4 bar. An injector piston diameter of 6 mm is used with a stroke length of 50 mm, giving a stroke volume of 1.41 ml. The average resulting time of the injector is about 1.41 seconds per cycle. This time period is divided between the valve settling before delivery, the delivery stroke, the valve settling after delivery and the suction stroke. A longer period is allowed for the suction stroke than for the delivery stroke. The overall time period is sufficient to satisfy the requirements for effective valve closure and the piston diameter to stroke ratio is adequately high to minimise the effects of seal flexing and accentuate the effectiveness of the end stop accuracy. An actuator piston diameter of 25 mm is used with a stroke of 50 mm matching the stroke of the injector piston. This can be shown to cause the force capability of the actuator to be about seven times greater than the maximum resistance resulting from the oil line pressure acting on the injector which is adequate to minimise the effects of variations in oil line pressure. In a properly designed system, this arrangement can readily provide accuracies within ±0.5%.

It will of course be understood that the invention is not limited to the specific details described herein, which are given by way of example only, and that various modifications and alterations are possible within the scope of the invention as defined in the appended claims.

What is claimed is:

1. An apparatus for the addition of a fluid additive to fluid and which is used in association with a flow meter, and which includes a reservoir for additive and a means for including the additive with the fluid, characterised in that the reservoir comprises an upper and a lower section, and in that the apparatus includes a means for replacing the additive in the reservoir in defined quantities, and means for detecting when the reservoir is depleted to a set level of additive between the upper and lower sections and means for recording the occurrence of the depletion of the reservoir to the set level between the upper and lower sections.

2. An apparatus according to claim 1, in which the upper and lower sections of the reservoir are joined by a narrow constriction.

3. An apparatus according to claim 2, in which the means for detecting when the reservoir is depleted to a set level is within the constriction.

4. An apparatus according to claim 1, in which the upper section of the reservoir has a volume which corresponds to a standard refill volume.

5. An apparatus according to claim 1, including a delivery means which is capable of delivering fluid with or without the additive.

6. An apparatus according to claim 1, in which the depletion of the reservoir is recorded by the recording means in chronological order among a chronological list of deliveries.

7. An apparatus according to claim 1, in which the recording means is operable to calculate an average value for the relative proportion of additive included in the fluid between recordings of the depletion of the reservoir.

8. An apparatus according to claim 1, where the means for including the additive includes means for injecting the additive in discrete amounts and the apparatus further includes means for recording the number of discrete amounts between recordings of the depletion of the reservoir for use in calculating the volume of the discrete amounts and a relative proportion of additive included in the fluid between the recordings of the depletion of the reservoir.

9. An apparatus according to claim 1, which includes a secure cabinet which encloses part of the apparatus and which comprises a door which is lockable and includes a sensor which detects when access is gained to the cabinet and where detected gaining of access to the cabinet is recorded by the recording means in chronological order among a chronological list of deliveries.

10. An apparatus according to claim 5, which includes a two-way valve associated with the delivery means where the two-way valve is enclosed within a secure cabinet and the two-way valve and the means for including additive with the fluid are interlocked within the cabinet preventing the means for including additive with the fluid from being operated unless the two-way valve is correctly set for addition of the additive.

11. An apparatus according to claim 9, wherein the additive reservoir and the means for including additive with the fluid are enclosed within the secure cabinet, which is adapted to be fitted substantially within a chassis of a delivery vehicle.

12. An apparatus according to any of claims 1–3 or 4–8, including an anti flush section which comprises retarding means and anti draining means.

13. An apparatus for the addition of a fluid additive to a fluid, comprising:

a reservoir for additive, wherein the reservoir comprises an upper section and a lower section;

means for adding the additive to the fluid by depleting the additive from the reservoir;

means for detecting when the reservoir is depleted to a set level of additive between the upper and lower sections;

means for replacing the additive in the reservoir in a defined quantity in response to detecting depletion of the reservoir to said set level; and means for counting the quantities of replaced additive by counting said detected depletions of the upper section of the reservoir to said set level.

* * * * *

UNITED STATES PATENT AND TRADEMARK OFFICE

CERTIFICATE OF CORRECTION

PATENT NO. : 6,478,189 B1
DATED : November 12, 2002
INVENTOR(S) : Brian Francis Mooney It is certified that error appears in the above-identified patent and that said Letters Patent is hereby corrected as shown below:

Title page,
Items [75], [73] and [30], in all instances, "IR" should read -- IE --.

Column 1,
Line 35, "such" should be -- much --.

Column 4,
Line 4, "(reservoir)" should be inserted after "tank"
Line 18, "arrangement" should be deleted
Line 41, -- arrangement -- should be inserted after "valve"
Lines 43 through 52, the following should be inserted:
-- 47 Delivery vehicle
48 Door
49 Lock
50 Chronological list of deliveries
51 Record the occurrence of the depletion of the reservoir
52 Make a check on a proportion of additive added to the fluid
53 Record an event associated with depletion of reservoir
54 Calculate average value for relative proportion of additive
55 Record number of discrete amounts of additive injected
56 Record an event associated with gaining access to the cabinet --

Column 5,
Line 8, -- 48 -- should be inserted after "door"
Line 9, -- 49 -- should be inserted after "lock"
Line 19, "nit" should be -- unit --

Column 6,
Line 48, "Automatically" should be -- automatically --
Line 49, after "sequence" the comma should be deleted and the following inserted
-- to provide a chronological list of deliveries 50 --

UNITED STATES PATENT AND TRADEMARK OFFICE

CERTIFICATE OF CORRECTION

PATENT NO. : 6,478,189 B1 
DATED : November 12, 2002
INVENTOR(S) : Brian Francis Mooney It is certified that error appears in the above-identified patent and that said Letters Patent is hereby corrected as shown below:

Column 15,
Line 53, the period after "sections" should be changed to a coma and the following should be inserted -- and for making a check on a proportion of additive added to the fluid. --

Signed and Sealed this

Ninth Day of September, 2003

JAMES E. ROGAN
*Director of the United States Patent and Trademark Office*